US008371044B2

(12) United States Patent
Rusnak

(10) Patent No.: US 8,371,044 B2
(45) Date of Patent: Feb. 12, 2013

(54) SHOES

(75) Inventor: Joel Rusnak, Newburyport, MA (US)

(73) Assignee: Polliwalks, Inc., Sudbury, MA (US)

( * ) Notice: Subject to any disclaimer, the term of this patent is extended or adjusted under 35 U.S.C. 154(b) by 566 days.

(21) Appl. No.: 12/505,893

(22) Filed: Jul. 20, 2009

(65) Prior Publication Data

US 2010/0126045 A1 May 27, 2010

Related U.S. Application Data

(63) Continuation-in-part of application No. 12/184,417, filed on Aug. 1, 2008.

(60) Provisional application No. 61/075,778, filed on Jun. 26, 2008, provisional application No. 60/953,246, filed on Aug. 1, 2007.

(51) Int. Cl.
*A43B 23/00* (2006.01)

(52) U.S. Cl. ..... 36/11.5; 36/136; 36/4

(58) Field of Classification Search ..... 36/112, 36/136, 4, 11.5; 12/142 S, 142 RS; D2/897–899, D2/948, 952
See application file for complete search history.

(56) References Cited

U.S. PATENT DOCUMENTS

| | | | |
|---|---|---|---|
| 438,179 | A | 10/1890 | Quarrie |
| 3,158,558 | A | 11/1964 | Bingham |
| 3,402,485 | A | 9/1968 | McMorrow |
| 3,538,628 | A | 11/1970 | Einstein |
| 3,906,642 | A | 9/1975 | Cohen |
| 4,050,167 | A | 9/1977 | Senter |
| 4,050,168 | A | 9/1977 | Pace |
| 4,279,049 | A | 7/1981 | Coiquaud |
| D260,447 | S | 9/1981 | Greenblatt et al. |
| D261,195 | S | 10/1981 | Weiss |
| D282,309 | S | 1/1986 | Valori |
| D282,310 | S | 1/1986 | Valori |

(Continued)

FOREIGN PATENT DOCUMENTS

| | | | |
|---|---|---|---|
| CN | 2618470 | Y | 6/2004 |
| CN | 2724453 | Y | 9/2005 |

(Continued)

OTHER PUBLICATIONS

Online webpage, Crocs Footwear, Crocs, Inc. (Niwot, Colorado); Downloaded Aug. 1, 2007, http://shop.crocs.com/c-4-Footwear.aspx?reqid=4&reqProdTypeId=4&subsectionname=footwear.

*Primary Examiner* — Marie Patterson
(74) *Attorney, Agent, or Firm* — Antoinette G. Giugliano; AGG Intellectual Property Law

(57) ABSTRACT

The present invention relates to a molded shoe featuring a 3 dimensional figure (e.g., an animal or character). The shoe has a sole having a bottom surface that comprises a series of projections and recesses that form a print for an animal or character, to thereby obtain an imprinting surface; and an upper, attached to the sole, having an outer surface that comprises a series of projections and recesses that form a three dimensional figure (e.g., an animal figure or a character figure). The sole and upper are substantially formed from molded plastic; the projections and recesses of the animal imprinting surface allow one wearing the shoe to make imprints on a soft surface, and the three dimensional figure on the outer surface of the upper relates to the print of the imprinting surface. The methods of the present invention further include making imprints with the bottom surface of the shoe.

In an aspect, the shoe of the present invention includes a sole that includes a bottom surface and an outsole extending therefrom; and a toe cap, wherein the toe cap and the outsole comprise an outer surface that comprises a series of projections and recesses that form a three-dimensional figure. The toe cap, the sole, the outsole, and the three-dimensional animal or character figure are a single piece formed by a molded material. This embodiment of the invention further includes a modified upper, adapted to attach to the toe cap and the outsole.

11 Claims, 13 Drawing Sheets

U.S. PATENT DOCUMENTS

| | | | |
|---|---|---|---|
| D290,062 | S | 6/1987 | Valori |
| 5,331,753 | A | 7/1994 | Rodibaugh |
| 5,465,507 | A | 11/1995 | Schumacher et al. |
| D366,752 | S | 2/1996 | Sherman |
| D378,009 | S | 2/1997 | Sullivan et al. |
| D381,795 | S | 8/1997 | Coats |
| D393,937 | S | 5/1998 | Henson |
| D394,137 | S | 5/1998 | Nadel |
| 5,765,300 | A | 6/1998 | Kianka |
| D397,541 | S | 9/1998 | Henson |
| 5,814,254 | A | 9/1998 | Bisconti |
| 5,837,174 | A | 11/1998 | Bisconti |
| 5,868,981 | A | 2/1999 | Bisconti |
| 5,974,694 | A | 11/1999 | Vecchiola |
| 5,980,351 | A | 11/1999 | McCook |
| D418,663 | S | 1/2000 | Senif |
| D422,778 | S | 4/2000 | Yang |
| D423,197 | S | 4/2000 | Yang |
| 6,080,033 | A | 6/2000 | Fladwood et al. |
| 6,189,240 | B1 | 2/2001 | Cowgill et al. |
| D479,386 | S | 9/2003 | Gebhardt |
| D487,614 | S | 3/2004 | Le |
| D489,516 | S | 5/2004 | Gebhardt |
| D490,218 | S | 5/2004 | Gebhardt |
| D498,038 | S | 11/2004 | Gebhardt |
| D498,907 | S | 11/2004 | Gebhardt et al. |
| D498,908 | S | 11/2004 | Gebhardt et al. |
| 6,957,504 | B2 | 10/2005 | Morris |
| 6,993,858 | B2 | 2/2006 | Seamans |
| D517,788 | S | 3/2006 | Seamans |
| D517,789 | S | 3/2006 | Seamans |
| D517,790 | S | 3/2006 | Seamans |
| D521,217 | S | 5/2006 | Moehring et al. |
| D525,017 | S | 7/2006 | Ochoa |
| D525,419 | S | 7/2006 | Seamans |
| D529,263 | S | 10/2006 | Wolf |
| D532,188 | S | 11/2006 | McClaskie |
| 7,146,751 | B2 | 12/2006 | Seamans |
| D535,088 | S | 1/2007 | Seamans |
| D543,681 | S | 6/2007 | McCarthy |
| D544,182 | S | 6/2007 | McClaskie |
| D547,540 | S | 7/2007 | Maderspach |
| D549,434 | S | 8/2007 | Seamans |
| D567,482 | S | 4/2008 | Hoyt |
| D604,031 | S | 11/2009 | Andersen et al. |
| 2002/0083623 | A1 | 7/2002 | Joseph |
| 2002/0166258 | A1 | 11/2002 | Posa |
| 2004/0231190 | A1 | 11/2004 | Seamans |
| 2006/0048407 | A1 | 3/2006 | Seamans |
| 2007/0130797 | A1 | 6/2007 | Seamans |

FOREIGN PATENT DOCUMENTS

| | | | |
|---|---|---|---|
| CN | 2761006 | Y | 3/2006 |
| FR | 2343395 | | 9/1977 |
| WO | WO 02/052972 | | 7/2002 |
| WO | WO 2004/064556 | A2 | 8/2004 |

10

20

40

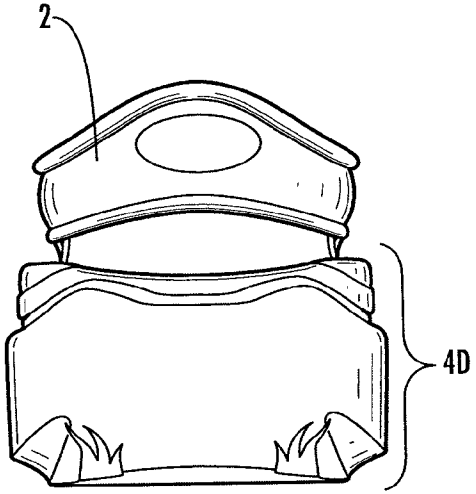
FIG. 4C
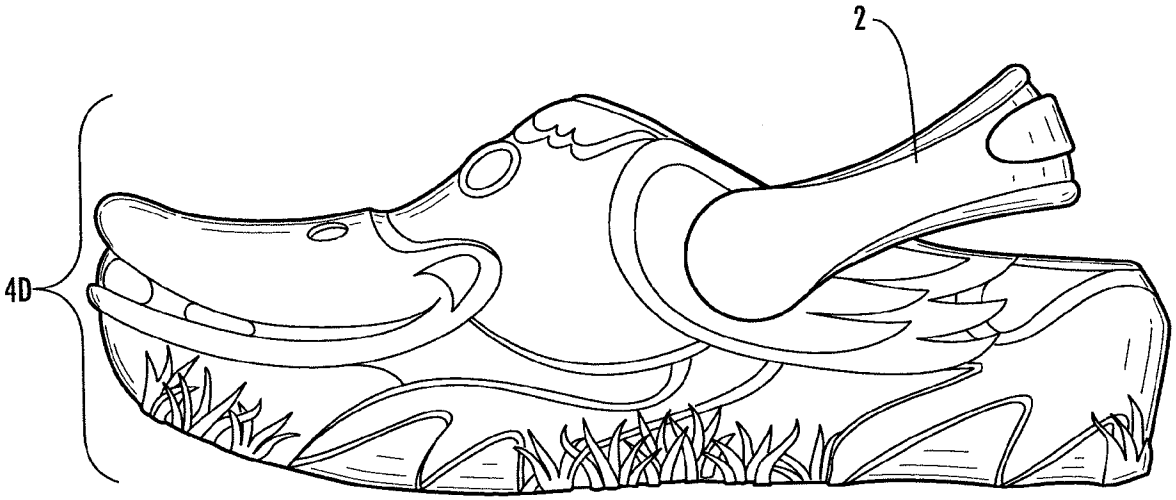
FIG. 4A
FIG. 4B
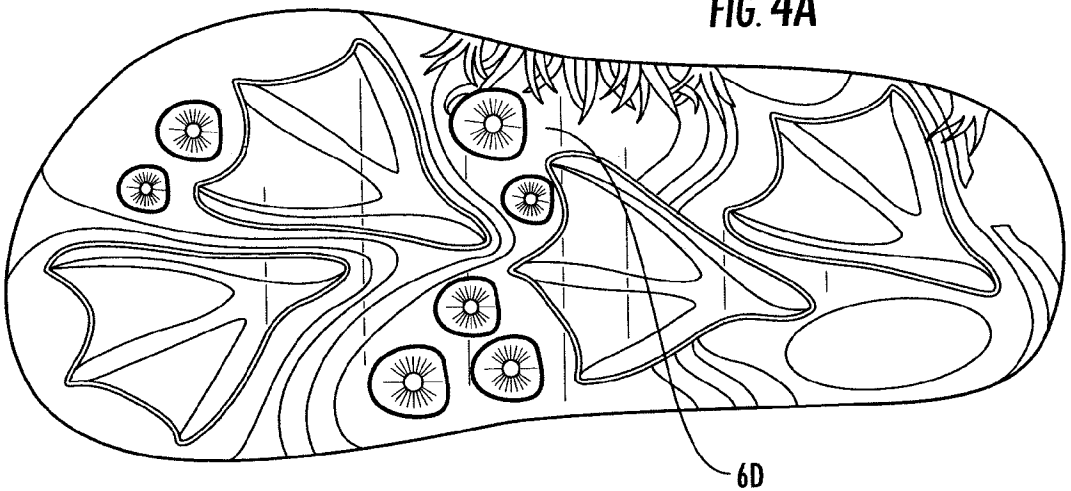
6D

SHOES

RELATED APPLICATION

This application is a Continuation-In-Part of U.S. patent application Ser. No. 12/184,417; filed Aug. 1, 2008, entitled "SHOES"; which claims the benefit of U.S. Provisional Application No. 61/075,778, entitled "SHOES" by Joel Rusnak, filed on Jun. 26, 2008; and U.S. Provisional Application No. 60/953,246, entitled "ANIMAL PRINT MAKING SHOES" by Joel Rusnak, filed on Aug. 1, 2007.

The entire teachings of the above applications are incorporated herein by reference.

BACKGROUND OF THE INVENTION

Shoes for children many times can lack a fun theme and/or three dimensional design. Children enjoy exploring and learning about new things. In particular, many children have a love of animals and characters, and like to learn about them.

A need exists for shoes that have three dimensional, fun themes. In particular, a need exists for shoes that have a three dimensional animal or character figure integrated into them. A further need exists to make a three dimension animal/character shoe that also makes imprints.

SUMMARY OF THE INVENTION

The present invention relates to a molded shoe featuring a three-dimensional figure. The shoe has a sole having a bottom surface that comprises a series of projections and recesses (e.g., contours) that form a print (e.g., an animal print, which include animal footprints or animal tracks), to thereby obtain an imprinting surface. The shoe further includes an upper, attached to the sole, having an outer surface that comprises a series of projections and recesses that form a three dimensional figure (e.g., an animal figure, character figure, or a figure that reflects a person's likeness). The recesses and projections of the figure of the upper is integrated with the sole, and the depth of the projections, recesses, or both of the upper range between e.g., about 2 mm to about 20 mm (preferably between about 3 mm and about 10 mm). In an embodiment, the 3 dimensional figure of the upper and the sole are one piece formed by a molded material. The sole and upper, in an aspect, are substantially or fully formed from molded plastic. Also, the projections and recesses of the imprinting surface (e.g., animal imprinting surface) allow one wearing the shoe to make imprints on a soft surface or hard surface when sole is wet. Preferably, and the figure on the outer surface of the upper relates to, corresponds to, or otherwise correlates with the print of the imprinting surface. The molded plastic, in an embodiment, made of recyclable material and is recyclable. In an aspect, the three-dimensional figure is an animal figure or a character figure. The animal figure of the upper includes e.g., a ladybug, an alligator, a frog, a duck, a dinosaur, bugs (e.g., a firefly and a bee), a turtle, a panther and fish.

In one aspect, the animal imprinting surface can be of footprints of the animal figure that forms the upper. The imprinting surface has projections, recesses, or both that have a depth that ranges between about 2 mm to about 10 mm (e.g., between about 2 mm and 5 mm) to thereby obtain an imprinting surface. The shoes can further include a strap for wrapping around the back of the ankle, wherein the strap has a first and second end attached to the upper. The upper includes a series of projections and recesses that form a three dimensional figure that has an eye, a mouth, animal skin pattern, feathers, scales, nose, teeth, grass, toes, feet, ears, fur, mouth, claws or any combination thereof.

An aspect of the invention includes the three dimensional figure (e.g., animal figure) integrated into the upper using the series of projections and recesses, as described herein, independent of the prints on the bottom surface of the shoe. Similarly, an embodiment of the present invention includes the series of projections and recesses that make the imprint (e.g., animal imprint) on the bottom surface of the sole, independent of the three dimensional figure of the upper. In yet another embodiment, the present invention relates to a shoe that has both.

The present invention further includes methods of making an imprint on a surface with a molded shoe, as described herein. The methods include stepping on the surface with a molded shoe of the present invention, as described herein. The surface is a soft surface that includes dirt, mud, sand or clay. In an embodiment, the method further includes coating the bottom surface with a print making solution, and stepping on to a surface like paper to make imprints. In yet another embodiment, the method includes wetting the bottom surface of the shoe and stepping on a dry surface to make the imprints.

In another embodiment, the present invention includes a shoe having a sole, as described herein, a toe cap, and an outsole, wherein the toe cap and/or outsole, rather than the upper, has an outer surface that comprises a series of projections and recesses that form a three-dimensional figure. Instead of the upper and the sole being a single molded piece, as described herein, in this embodiment, the toe cap, the sole, the outsole, and three-dimensional figure are a single piece formed by a molded material. With this embodiment, the shoe further includes a modified upper, adapted to attach to the toe cap and outsole. Examples of uppers modified to adapt to fit the toe cap include a sneaker upper, a "Mary Jane" upper, a boot upper, a slipper upper, and a sandal upper. The upper includes straps, hook and loop fasteners, laces, zippers, buttons, fasteners, and the like. The projections, recesses or both of the toe cap and/or outsole have a depth that ranges e.g., between about 2 mm to about 20 mm (e.g., preferably between about 2 and 10 mm). The animal imprinting surface has projections, recesses, or both that have a depth that ranges e.g., between about 2 mm to about 5 mm to thereby obtain an animal imprinting surface. As described herein the sole has a bottom surface that comprises a series of projections and recesses that form a print to thereby form an imprinting surface, wherein the figure on the outer surface of the toe cap relates to the print of the imprinting surface. The molded material or a thermoplastic material can be used. Examples include Ethylene Vinyl Acetate (EVA), rubber, ThermoPlastic Rubber (TPR), Polyurethane (PU), (PolyVinyl Chloride) PVC, or a combination of any of these materials combined with these or other materials. In certain aspects, the molded plastic is recyclable or made from recycled material.

In an aspect, the present invention includes a sole having a bottom surface that comprises a series of projections and recesses that form an animal print for an animal, to thereby obtain an animal imprinting surface; and a toe cap and outsole, wherein the toe cap and outsole include an outer surface that comprises a series of projections and recesses that form a three-dimensional animal figure, wherein the toe cap, the sole, outsole, the animal imprinting surface, and three-dimensional animal or character figure are a single piece formed by a molded material; and a modified upper, adapted to attached to the toe cap. The projections and recesses of the animal imprinting surface allow one wearing the shoe to make imprints, and the animal figure on the outer surface of the upper relates to the animal print of the animal imprinting surface. As used herein, the animal can refer to a three dimensional real animal (e.g., an inch worm or a lizard) or a fictional animal (e.g., a treeper or tree creeper). In an aspect, the toe cap and/or outsole includes a series of projections and recesses that form an animal figure that has eyes, mouth, animal skin pattern, feathers, scales, nose, teeth, grass, legs, toes, feet, ears, fur, mouth, claws or any combination thereof.

The present invention relates to methods of making the shoe described herein. The methods include injecting molten plastic into a mold having an inverse image of the sole, the toe cap and the outsole having the series of projections and recesses that form the three-dimensional figure, to thereby obtain a molded shoe; and after the sole/toe cap/outsole has cooled, attaching a modified upper to the toe cap. The molten plastic comprises EVA, rubber, TPR, PU, PVC, or a combination of any of these materials combined with these or other materials.

The present invention has several advantages. Children can now enjoy shoes with three dimensional animals or figures integrated within the shoe. At the same time, children can learn and/or make foot prints of the animal or character while wearing the shoe.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

FIG. 4A-4C are schematic drawings of a side view, bottom view and a back view, respectively, of a molded shoe featuring a duck.

DETAILED DESCRIPTION OF THE INVENTION

Figure 1C:
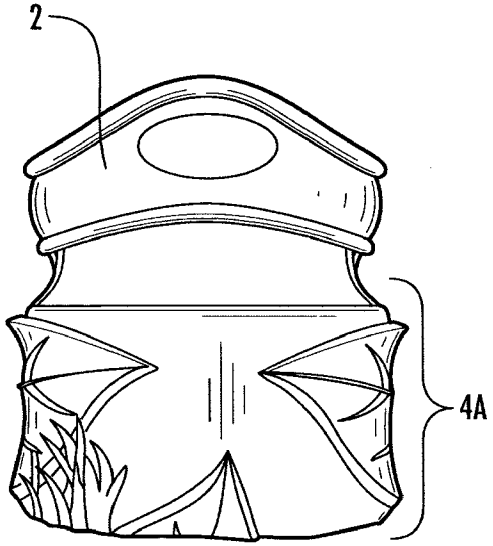
FIG. 1A-1C are schematic drawings of a side view, bottom view and a back view, respectively, of a molded shoe featuring a ladybug.

A description of preferred embodiments of the invention follows.

The present invention relates to a molded shoe that features a three dimensional figure. In an embodiment, the three dimensional figure can be an animal, a character, or of a person's likeness. The molded shoe of the present invention includes a series of projections and recesses that form a pattern (e.g., an animal pattern or a character pattern) on the bottom surface of the sole, and/or has a three dimensional figure integrated into the upper (e.g., tops of the shoe, sides of the shoe, the back of the shoe), or toe cap of the shoe.

As referred to herein, a sole is a portion of the shoe that forms the bottom part of the shoe; the part on which the foot rests. The sole has a bottom surface that comes into contact with the ground or floor, or other surface on which a person is walking. Another portion of the shoe is the upper. The upper, also known as a vamp, is the portion of the shoe that holds the shoe onto the foot. In an embodiment, the upper is the portion of the shoe that covers the toes, the instep, the back of the foot, and/or the sides of the foot.

In an embodiment, the shoe of the present invention includes a toe cap. The toe cap is a portion of the shoe that comes from the sole and covers the toes. The outsole is the portion of the shoe that extends from the sole to the outer, side and heal surfaces of shoe. As used herein, the toe cap covers the toes, and the outsole continues the design from one side of the toes (e.g., the big toe side) and wrap around the heal and back to the other side of the toes (e.g., the pinky toe side). In the case in which the shoe includes a toe cap, the shoe can further include a modified upper to extend from the toe cap to cover the instep, sides of the foot, ankle and/or lower leg (e.g., in the case of a boot). The upper is modified so that it no longer covers the toes, but extends from the toe cap and the outsole to otherwise hold the shoe on the foot. The shoe of this embodiment includes modified uppers such as clogs, boots, sandals, slippers, sneakers, "Mary Jane" shoes, and the like.

In an embodiment, the molded shoe of the present invention includes a sole having a bottom surface. The bottom surface can be shaped such that all or a portion of the surface comes into contact with the ground. In the case of a flat shoe, all or substantially all of the surface comes in contact with the walking surface, whereas in the case of a heel, portions (e.g., the ball of the foot and the heal) of the shoe comes into contact with the walking surface. The bottom surface of the molded shoe of the present invention has a series of projections and recesses that form various imprinting surfaces featuring a print that correlates to the three-dimensional figure, such as an animal print or character print. The projections and recesses are shaped and contoured to form the print. The print (e.g., animal print) can include variety of items related to the three dimensional figure of the upper, e.g., foot prints, tracks, leaves, animal shapes, lily pads, grass, and any combination thereof. Other animal related items can form the imprinting surface of the shoe of the present invention. In a preferred embodiment, the animal print on the bottom surface includes a footprint of the featured animal (e.g., the animal that forms the three dimensional portion of the upper).

The projections and recesses (e.g., indentations) on the sole are deep enough to make an imprint on a surface. In an embodiment, the projections, recesses or both of the imprinting surface have a depth that ranges between about 2 mm to about 10 mm (e.g., preferably between about 2 and 5 mm). In an embodiment, the surface on which the imprint is made is a soft surface, such as dirt, sand, or mud. In another embodiment, the surface can be a hard or non-spongy surface, and the bottom surface of the shoes of the present invention can be coated with an imprinting solution (e.g., washable paint). In yet another embodiment, the bottom surface can be coated with a solution that only appears on paper that reacts to the solution. Still in another embodiment, the bottom surface can be wetted and prints can be made on a dry surface.

The present invention, in an aspect, further includes an upper, a toe cap and/or outsole that has an outer surface (e.g, an outer layer) with a series of projections and recesses that form an animal figure, a character figure or other three-dimensional figure. In an embodiment, the projections, recesses or both of the three dimensional figure have a depth that ranges between about 2 mm to about 20 mm (e.g., preferably between about 2 and 10 mm). In the embodiment in which the upper has the three-dimensional figure, the figure can be integrated into all or any portion of the shoe upper which includes the portions which cover the instep, the toes, the back of the foot, and the sides of the foot. In the case of the toe cap, the three-dimensional figure is formed in at least a portion of the toe cap and/or outsole. In embodiment, the three-dimensional figure is formed substantially all throughout the top cap and includes the outsole e.g., the three dimensional figure is formed around the toes, extending to the sides and wraps around the heal. In the case in which the sole and upper include the three-dimensional figure, the sole and the upper are 1 piece formed by a molded material. In the case in which the toe cap includes the three-dimensional figure, the sole and the toe cap are 1 piece formed by a molded material. In yet another embodiment, the sole, the outsole and the toe cap are 1 piece formed into a three-dimensional figure by a molded material. In this embodiment, a modified upper is adapted to attach to the toe cap. In such an aspect, the upper is adapted to cover less of the foot, and reduced such that it no longer covers the toes. In the case in which the three-dimensional figure covers the toes and goes from the toes along the sides and wraps around the heal, the upper is reduced so that it does not cover the toes, and does not extend to the portion of the sides and heal that is already covered by the toe cap and the outsole. The modified upper is attached to the toe cap with adhesive, stitching, or other methods for adhering molded material with synthetic or stitched leather.

The figure (e.g., animal figure), in an embodiment, has eyes, mouth, nose, ears, hair, feathers, scales, wings, a skin pattern, grass, and any combination thereof. The figure is a three dimensional figure that is integrated with the upper and/or toe cap, as compared to two dimensional pictures or drawings that are printed onto the shoe. The projections and recesses are contoured and shaped to form the three dimensional figure. The shoe of the present invention can be formed into any animal figure, and some examples shown in the figures include a ladybug, alligator, frog and duck. Additional animal figures can be formed as part of the shoe, as described herein, and they include dinosaurs, tigers, lions, snakes, penguins, dragons, giraffes, elephants, pandas, bears, butterflies, dragonflies, hippopotamus, bugs (e.g., a firefly and a bee), a turtle, a panther, fish, an inch worm, a lizard, a creeper, etc. or any other anima, real or fictional. Examples of types of dinosaurs include triceratops, archaeopteryx, compsognathus, tyrannosaurus, apatosaurus, ichthyosaurs, mosasaurs, plesiosaurs, pterosaurs, dimetrodon, ankylosaurus, dimetrodon, ammosaurus and iguanodon. In an embodiment, the figure can be of a character (e.g., fictional or non-fictional character). Examples of fictional characters include those seen in cartoons, plays, on TV shows, and the like. Characters further include using the likeness of a person including famous persons. The three-dimensional figure of the upper includes three dimensional characters having general overall features, shape, likeness of the person or character (e.g., hats, hairstyle, accessories, instruments, clothing, and the like). The shoes can be of any color or color combination. An aspect of the invention includes a shoe with an upper having a three dimensional figure or animal integrated therein.

Figure 1A:
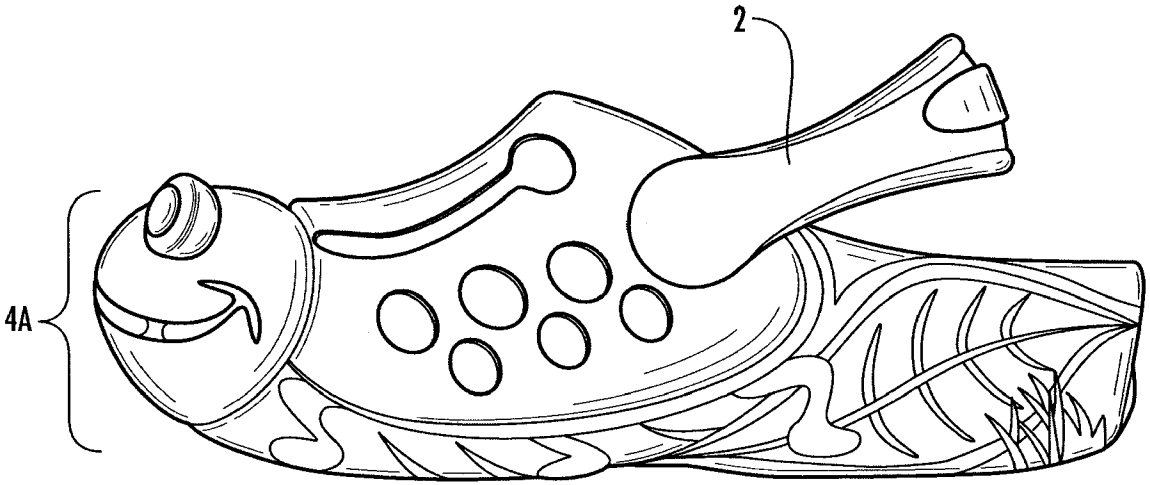
Figure 1B:
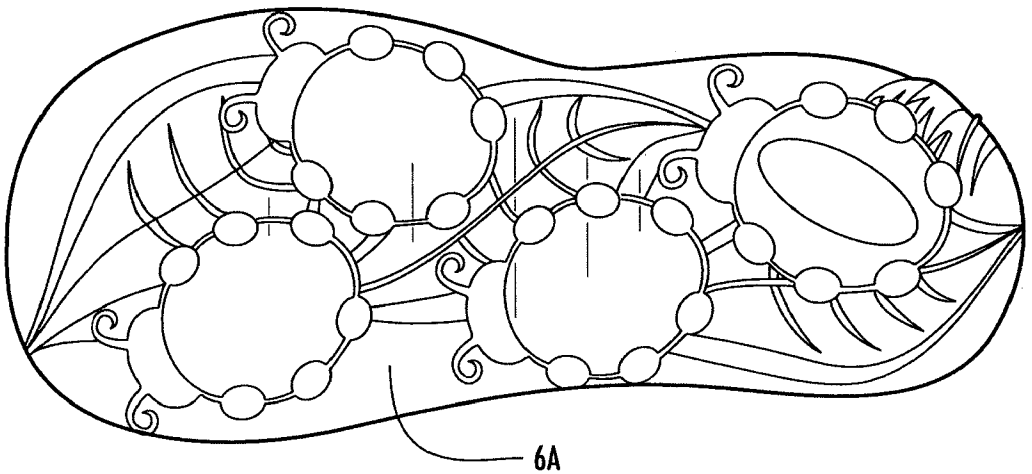

Referring to FIGS. 1A-C shows ladybug shoe 10 of the present invention. FIG. 1A shows a side view of the molded shoe and has strap 2 and lady bug upper 4A which is formed by a ladybug's body which includes a mouth, eyes, and wings having a wing pattern. The shoe design further includes ladybug feet, leaves and grass. The ladybug shape is formed from a series of projections and recesses that are integrated into a three dimensional animal figure of the upper. The upper can further include openings e.g., to accentuate the animal pattern such as the wing pattern.

The shoe shown in the figure is a clog. However, the shoe can be embodied in other types of shoes such as sandals, boots, closed shoes and other types known in the art.

The shoe further includes strap 2, when worn, wraps round the back of the ankle. The strap for use with the present invention has two ends, each end attaching to a portion of the upper. The strap can be stationary or pivot. Additionally, the strap can be made of molded plastic, or from another material (e.g., cloth, leather), or combination thereof. The strap, in an embodiment, can use an attaching and/or adjustable means that include a buckle, snaps, velcro, buttons, fasteners, or other methods known in the art or later developed. The strap can be attached directly or indirectly. For example, washers can be used to indirectly connect the strap end and the shoe to allow the strap to more easily rotate.

In an embodiment, the shoe and the strap is made from molded plastic, or a material that is recyclable. The shoe of the present invention, in one aspect, is made of recyclable material and is recyclable. The shoe can further include a logo, trademarks or a recycle symbol on any part of the shoe including the bottom imprinting surface.

The bottom surface of sole 6A shown in FIG. 1B shows an animal imprinting surface. This particular surface shows series of ladybugs on leaves. Hence, when a person or child wearing the shoes walks on a soft surface, an imprint of ladybugs on leaves will be made. In addition to an outline of the featured animal, animal footprints can form the imprint surface (see soles 6B, 6C, and 6D of FIGS. 2B, 3B, and 4B, respectively). Other animal figures, of the present invention, that form the imprinting surface of the present invention include animal symbols, names, habitats, (e.g., grass, leaves, rocks, water), animal outlines, and the like. The animal figures that form the imprinting surface can be repetitive or non-repetitive. In a preferred embodiment, the animal imprinting surface on the bottom surface of the sole relates to or matches the animal figure of the upper. For example, webbed feet imprinting surface with a duck animal figure is used in an embodiment. The animal print of the imprinting surface relates to the anatomy, habitat or way of life of the featured animal of the upper.

Figure 2C:
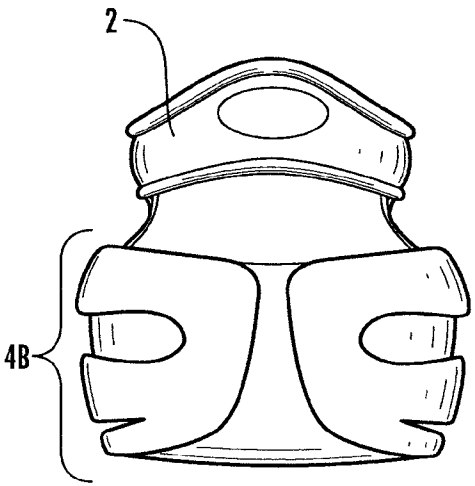
FIG. 2A-2C are schematic drawings of a side view, bottom view and a back view, respectively, of a molded shoe featuring an alligator.
Figure 2A:
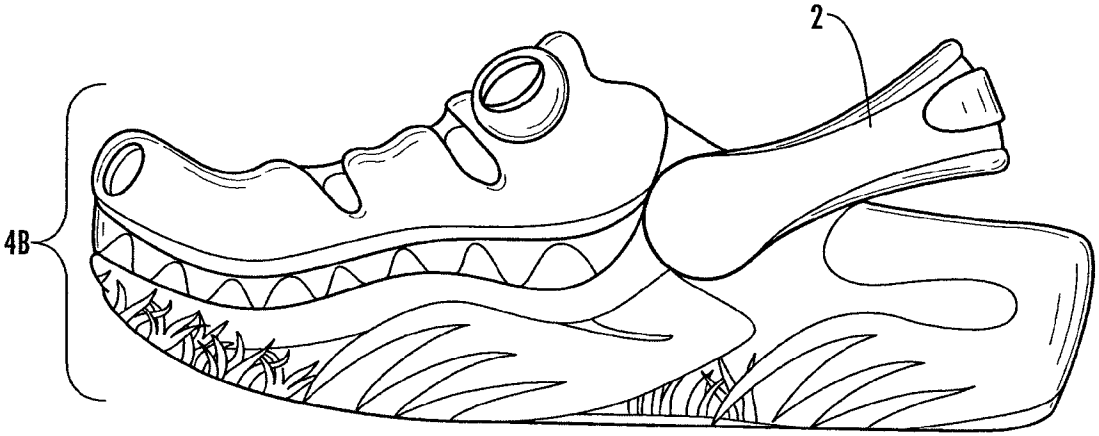
Figure 2B:
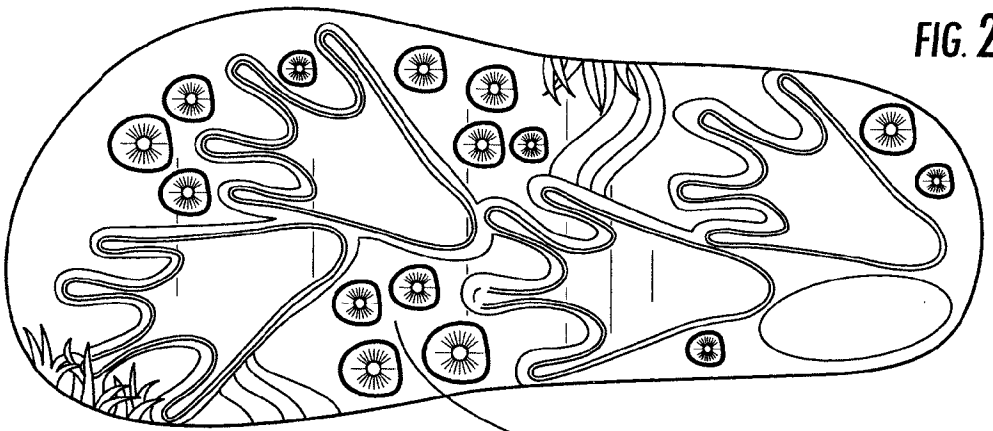

Referring to FIGS. 2A-2C, alligator shoe 20 of the present invention features an alligator. In these figures, alligator upper 4B includes contours (e.g., projections and recesses) that shape the alligator's mouth, teeth, beak, eyes, and skin pattern. The projections and recesses are further shaped to include swamp-like grass. The bottom imprinting surface of sole 6B has a series of contours that form alligator feet and lily pads.

Figure 3C:
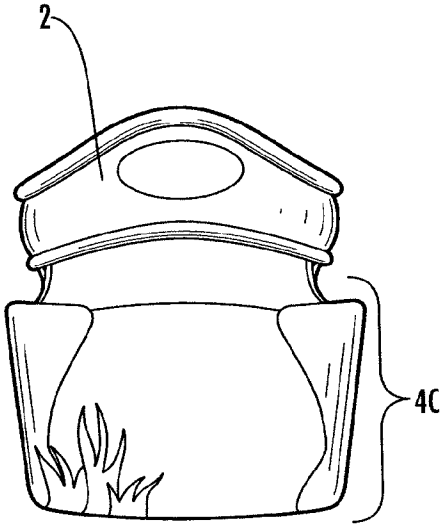
FIG. 3A-3C are schematic drawings of a side view, bottom view and a back view, respectively, of a molded shoe featuring a frog.
Figure 3A:
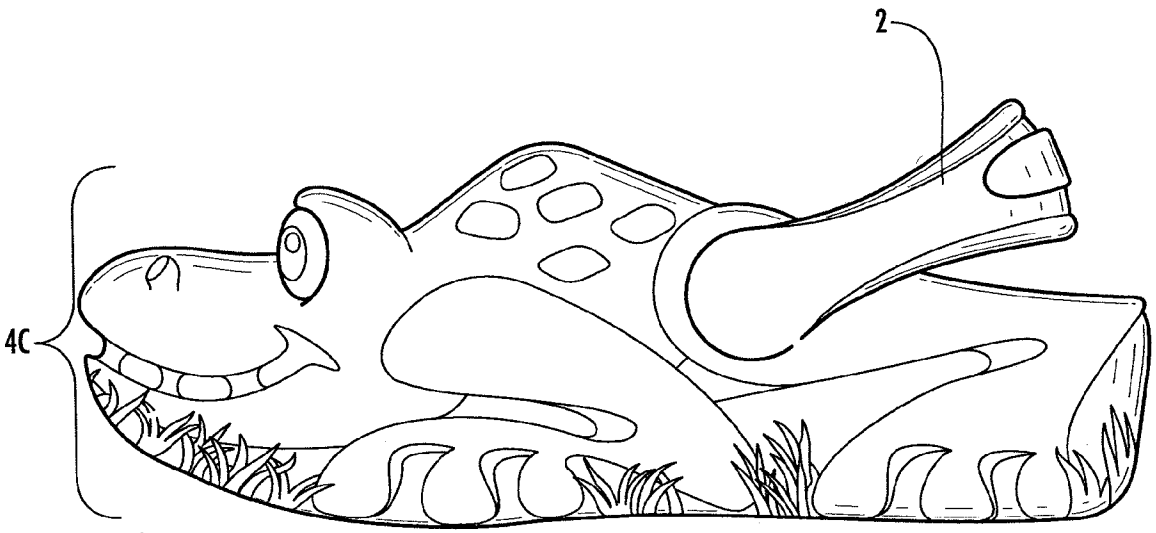
Figure 3B:
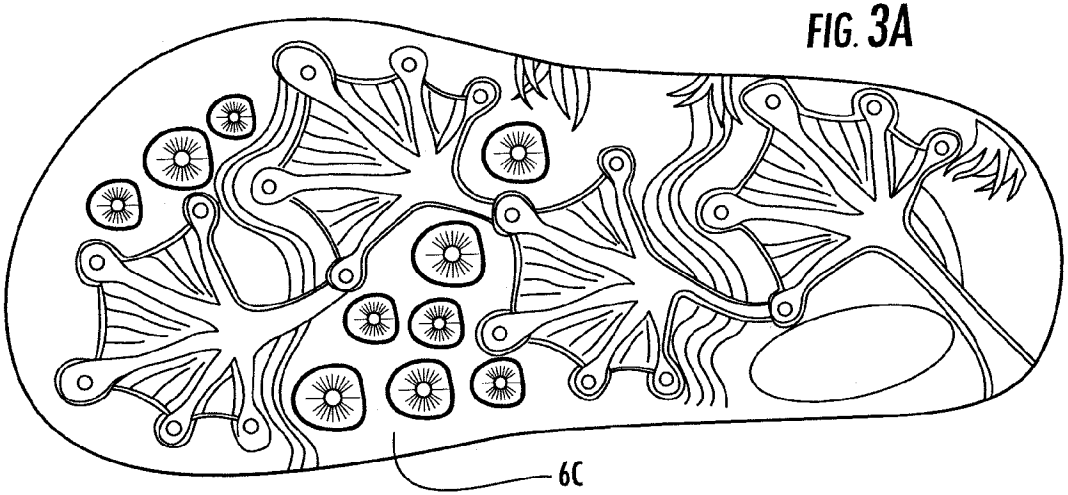

Similarly, FIGS. 3A-C shows the plastic molded frog shoe 40 of the present invention in which the contours form a three dimensional frog. Frog upper 4C includes projections and recesses that are shaped to include a mouth, eyes, nostrils, the frog's skin pattern (e.g., bumpy), and its habitat that includes grass. The imprinting surface of sole 6C has projections and recesses that form webbed feet, lily pads and grass.

A three dimensional duck figure is the focus of duck shoe 60 shown in FIGS. 4A-C. Duck upper 4D's projections and recesses form the ducks beak, nostrils, mouth, eyes, feathers, and grass, while the corresponding bottom surface of sole 6D is shaped to formed duck feet, lily pads, and grass.

Figure 5A:
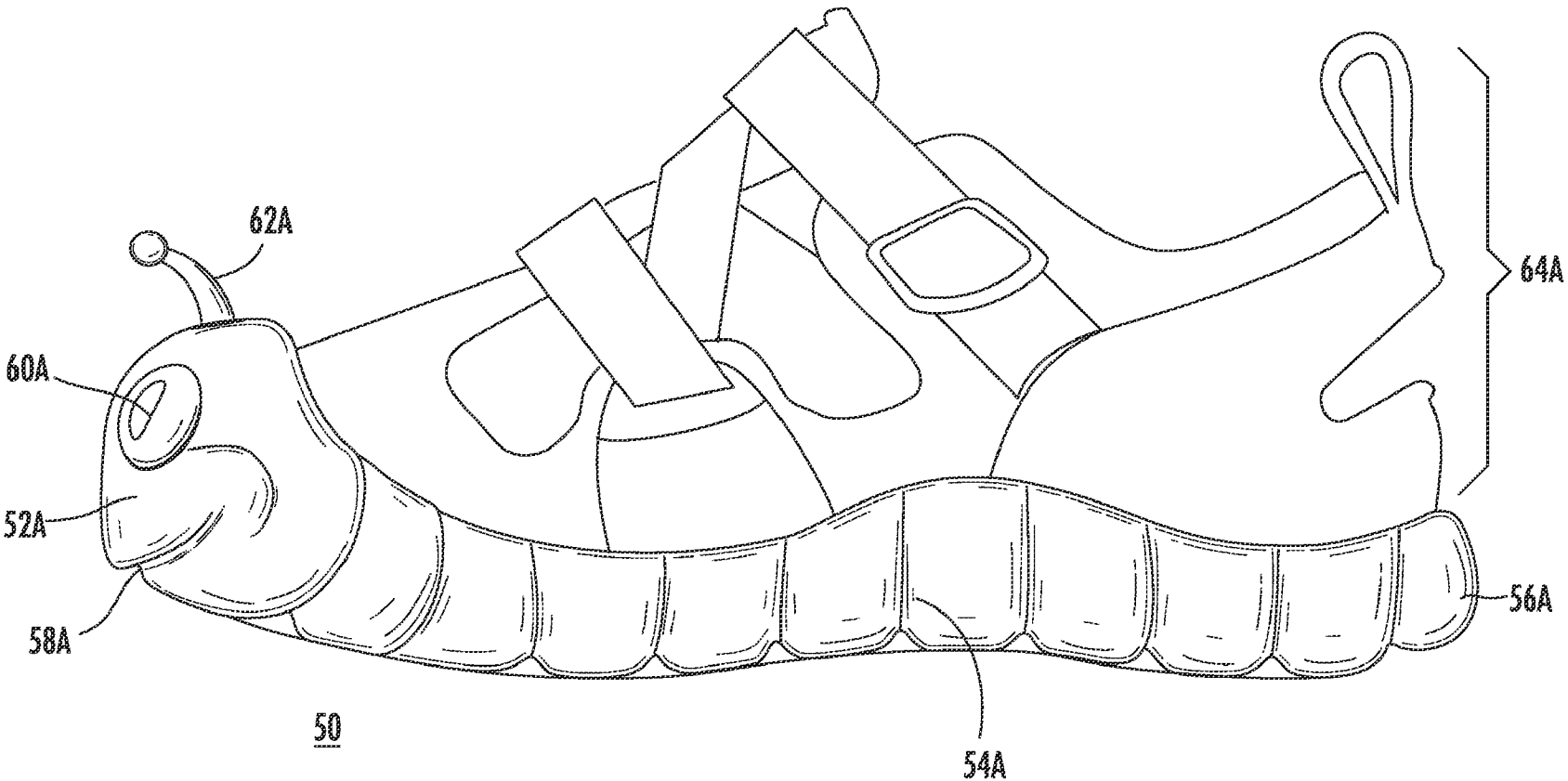
FIG. 5A is a schematic drawing of a side view of a three-dimensional inch worm figure made from a sole and toe cap into a single piece formed by a molded material. The figure shoes a modified Z-strap upper.
Figure 5B:
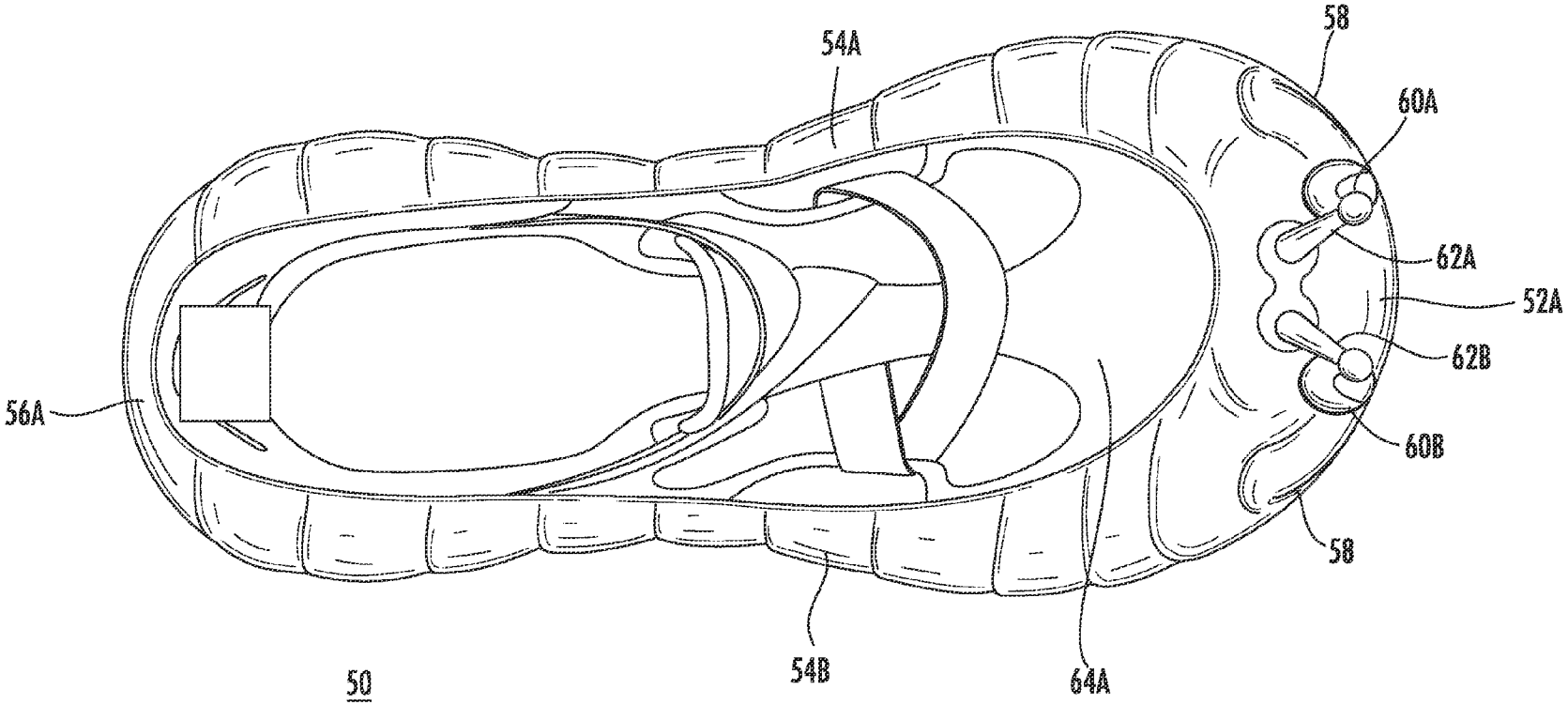
FIG. 5B is a schematic drawing of a top view of the three-dimensional inch worm shoe of FIG. 5A.
Figure 5C:
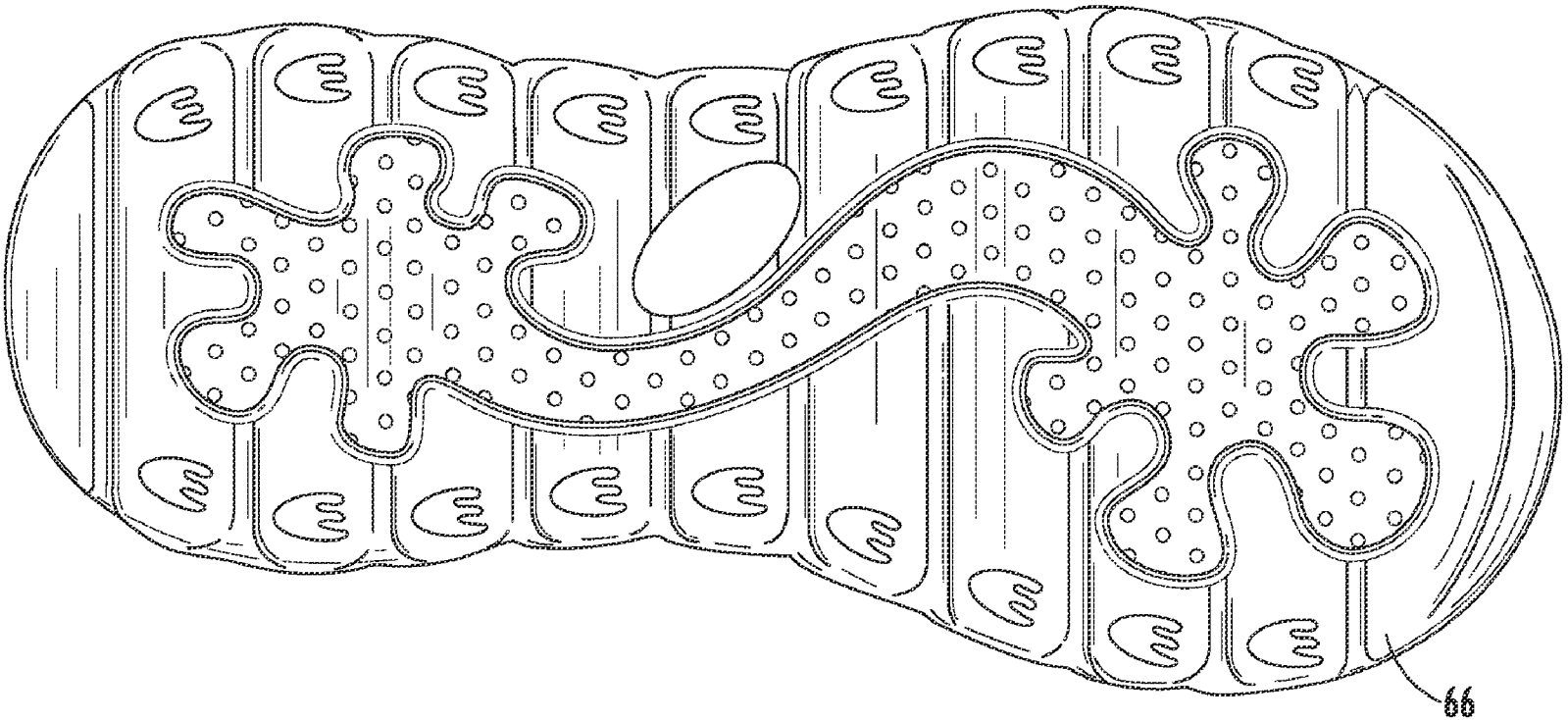
FIG. 5C is a schematic drawing of a bottom view showing the imprinting surface of the three-dimensional inch worm shoe of FIG. 5A.

FIG. 5A shows a side view of three-dimensional inch worm shoe 50. In this embodiment, toe cap 52A, outsole 54A, 56A and 54B and sole 66 are 1 piece, formed by molded material. The toe cap 52A has the three-dimensional figure made from a plurality of recesses and projections, as described herein. The toe cap covers the toes and extends to outsole 54A, wraps around the heal at outsole 56A, and extends along the other side at outsole 54B. The toe cap serves to protect the toes. The outsole together with the toe cap forms the three-dimensional figure. In particular, toe cap 52A includes eyes 60A and 60B, mouth 58A and antenae 62A and 62B to form the three-dimensional face of the inchworm figure. The three dimensional design continues to outsole 54A, 56A and 54B as the inch worm's body. The recesses and projections that form the three dimensional figure have a depth that ranges between 2 mm and about 20 mm. FIG. 5B, showing the top view of three-dimensional inch worm shoe 50. The top view shows that outsole 54A, 56A, and 54B forms the three-dimensional body of the inch worm. Sole 66 has a bottom surface with a imprinting surface that relates to the inch worm figure of the toe cap. See FIG. 5C. As described herein, the imprinting surface is a series of recesses and projections that form a pattern that relates to the figure. In this case, the pattern includes the footprint of an inch worm. These recesses and projections have a depth that ranges from about 2 mm to about 10 mm.

Figure 5D:
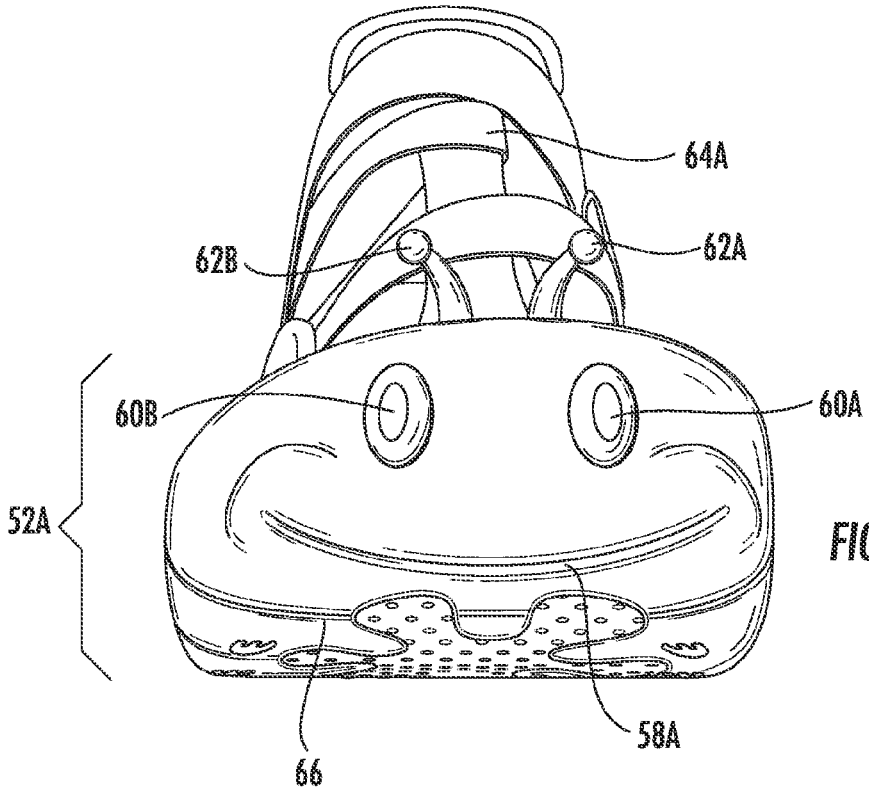
FIG. 5D is a schematic drawing of a front view of the three-dimensional inch worm shoe of FIG. 5A.
Figure 5E:
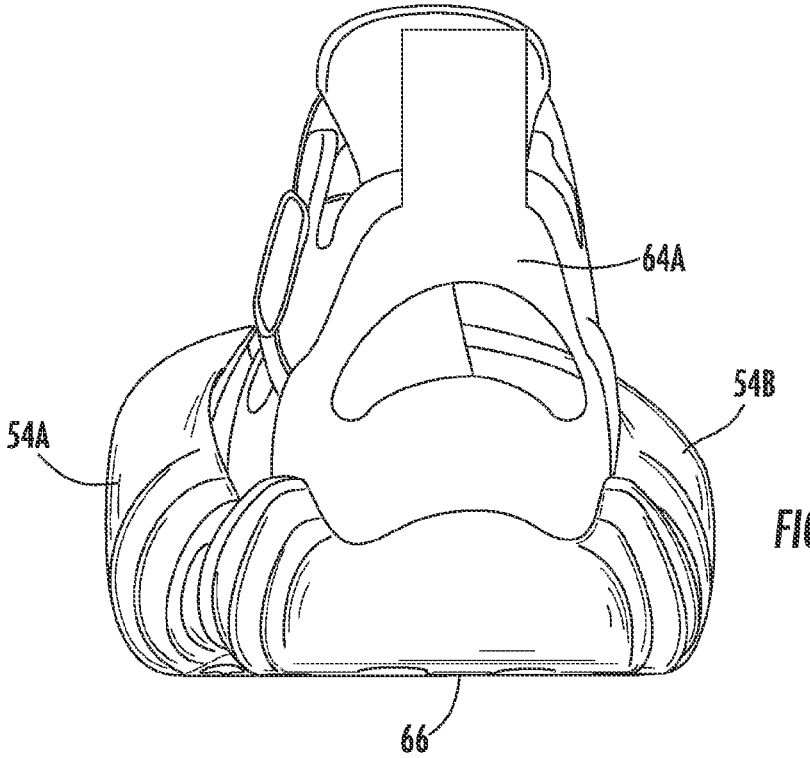
FIG. 5E is a schematic drawing of a back view of the three-dimensional inch worm shoe of FIG. 5A.

The front and back views are shown in FIGS. 5D and 5E of three-dimensional inch worm shoe 50. From these views, it can be more clearly seen that the toe cap and outsole form an three-dimensional figure, rather than a flat image that is painted on or otherwise adhered to the surface.

Figure 5F:
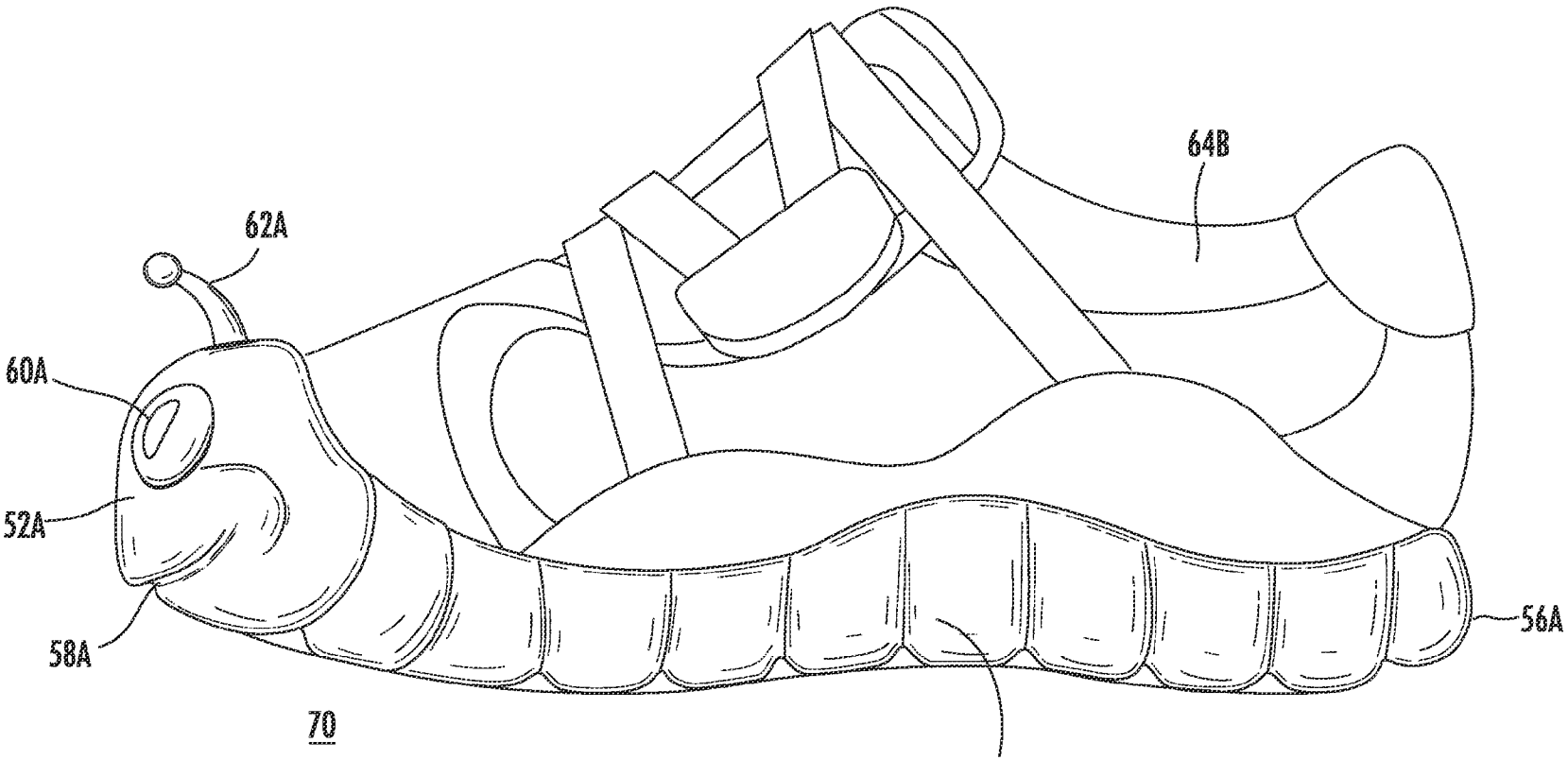
FIG. 5F is a schematic drawing of a side view of a three-dimensional inch worm figure made from the sole and toe cap shown in FIG. 5A, but with a modified sneaker upper having a hook and loop fastener.
Figure 5G:
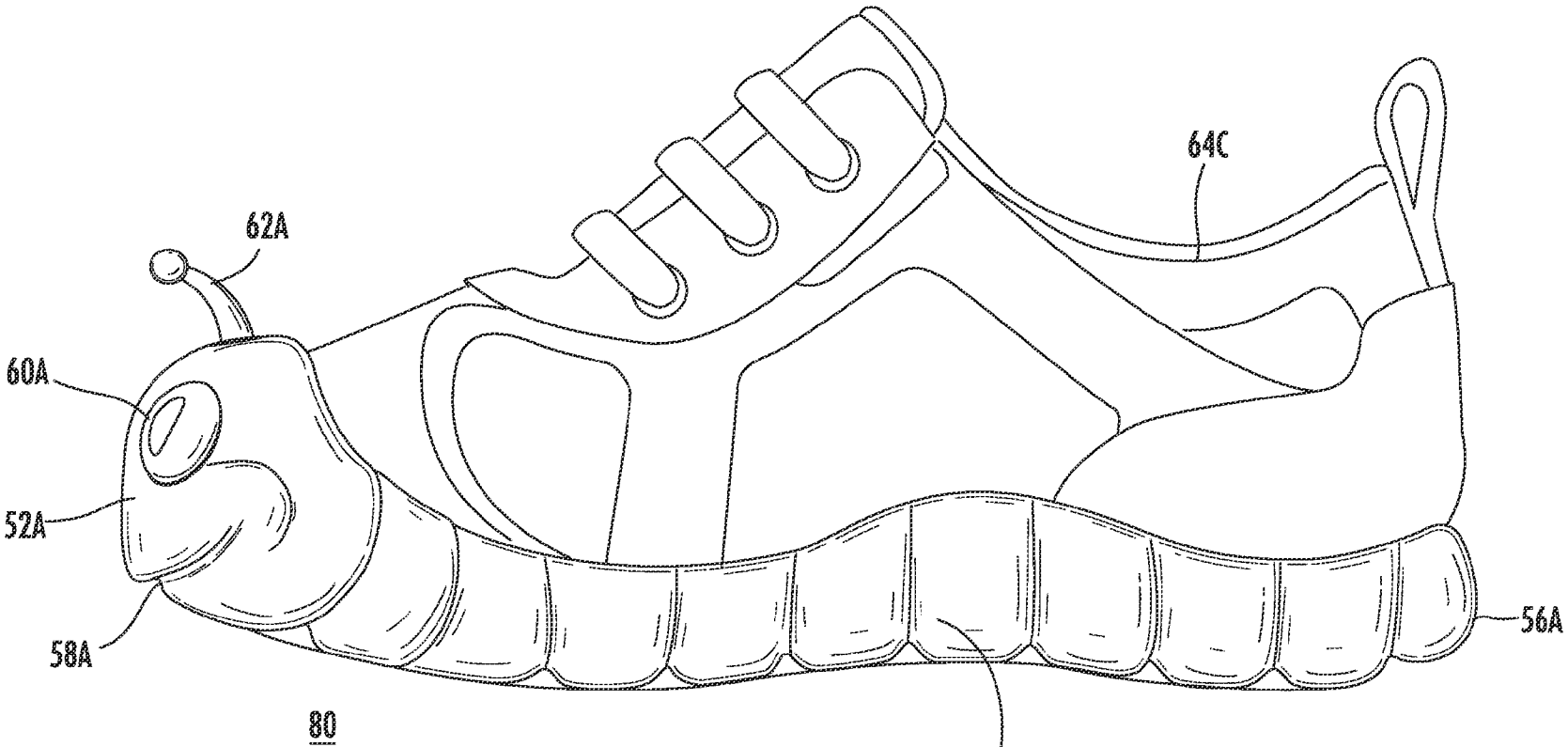
FIG. 5G is a schematic drawing of a side view of a three-dimensional inch worm figure made from the sole and toe cap shown in FIG. 5A, but with a modified sneaker upper having laces.
Figure 5H:
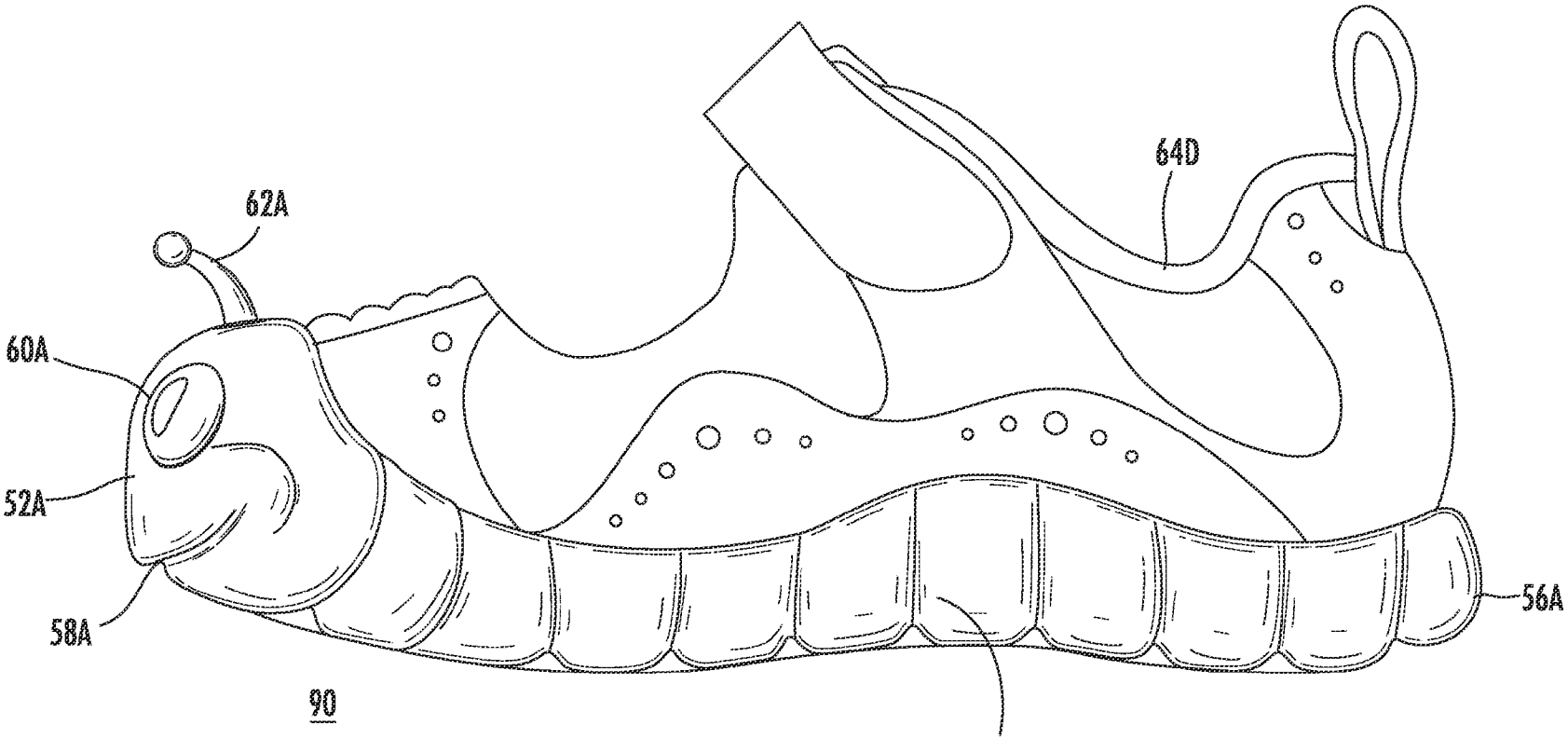
FIG. 5H is a schematic drawing of a side view of a three-dimensional inch worm figure made from the sole and toe cap shown in FIG. 5A, but with a modified "Mary Jane" upper.

FIGS. 5A-5E show three-dimensional inch worm shoe 50 with a modified upper, namely Z-strap upper 64A. The upper is modified to fit the 1 piece molded toe cap/outsole. The upper is adapted to fit a smaller surface area of the foot, reduced by that which is already covered by the toe cap/outsole. The modified uppers can be substituted by several other types of uppers. For example, the uppers, in this aspect, can be stitched leather and/or made from synthetic materials. FIGS. 5F, 5G, and 5H show three-dimensional inch worm shoe 70, 80 and 90 respectively. The difference between these shoes is the modified upper used. In three-dimensional inch worm shoe 70, has modified sneaker upper 64B, which uses a hook and loop fastener. The design in FIG. 5G utilizes modified sneaker upper 64C having laces, and the shoe design of FIG. 5H uses modified "Mary Jane" upper 64D.

Figure 6:
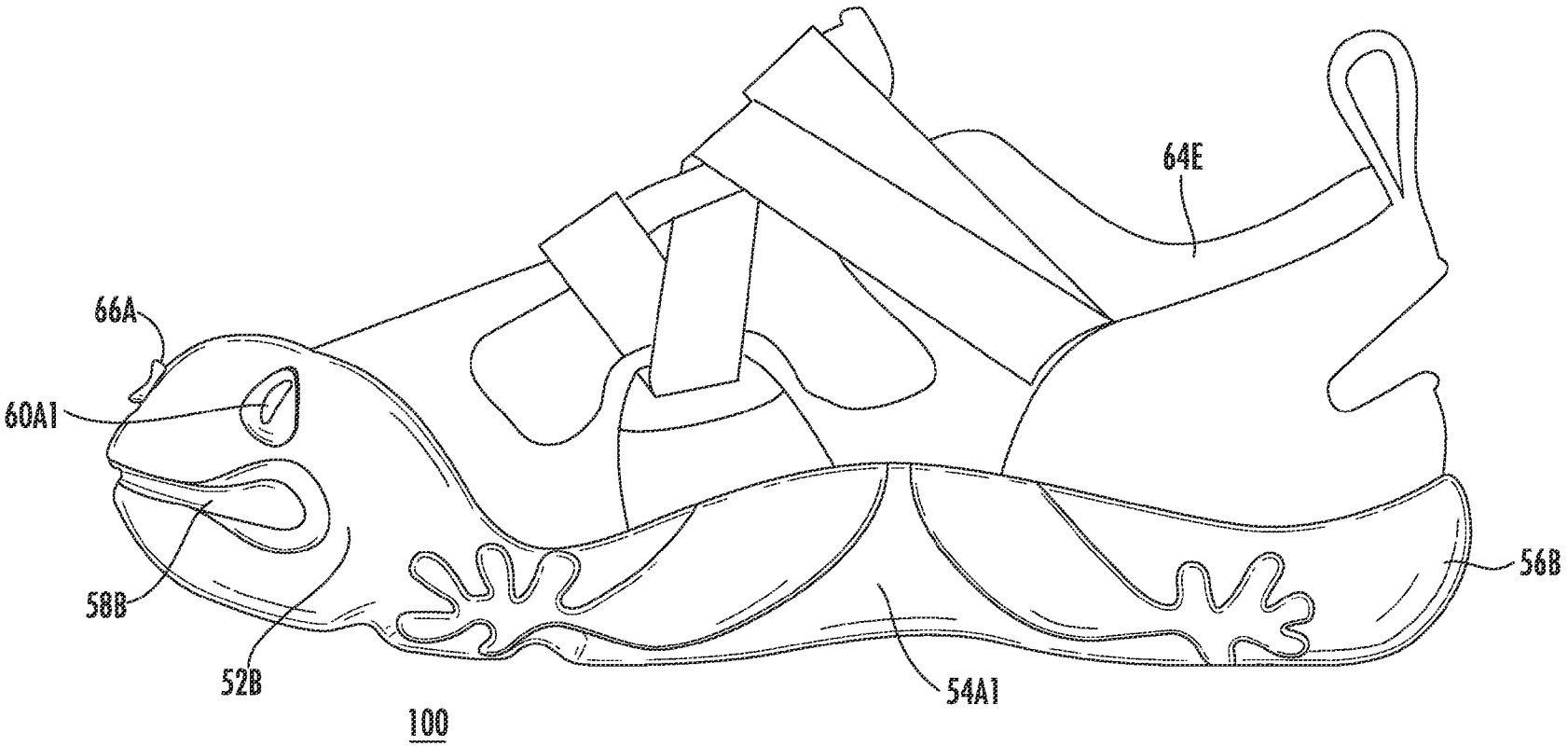
FIG. 6 is a schematic drawing of a side view of a three-dimensional lizard figure made from a sole and toe cap into a single piece formed by a molded material. The figure shoes a modified Z-strap upper.

Similarly, FIG. 6 shows another design that utilizes a toe cap and outsoles to form the three-dimensional figure. In this case, three-dimensional lizard shoe 100 is shown. In this case, the face of the lizard figure includes mouth 58B, eyes 50A1 and 60A2 (not shown) and nostrils 66A and 66B (not shown). The various features are designed to resemble a lizard. Outsole 54A1, 56B and 54B1 (not shown) includes the body and the legs of the lizard. The design of the outsole is continuous from the design of the toe cap. Modified Z-strap upper 64E is utilized in this embodiment of the lizard shoe. However, any of the modified uppers, as described herein can be used. Any upper known in the art or developed in the future, can be adapted to be used with the toe cap and outsoles having a three dimensional design of the present invention.

Figure 7:
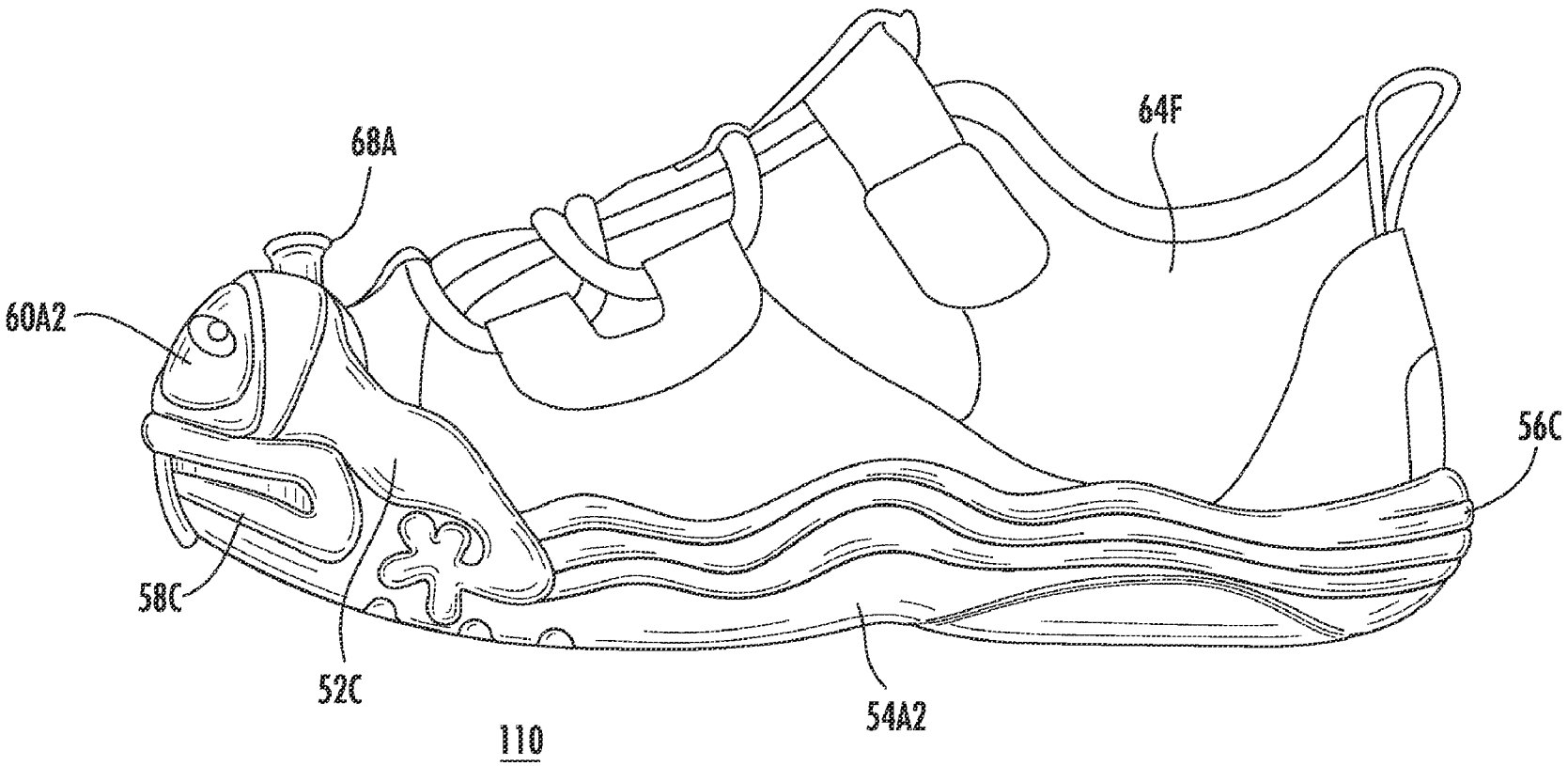
FIG. 7 is a schematic drawing of a side view of a three-dimensional fictional tree creature figure made from a sole and toe cap into a single piece formed by a molded material. The figure shoes a modified sneaker upper with laces and a hook and loop fastener.

FIG. 7 shows a fictional animal character, three-dimensional treeper shoe 110. The animal figure is a fictional tree creeper. The face of toe cap 58C is comprised of mouth 58C, eyes 60A2 and 60B2 (not shown), horn 68A and 68B (not shown). The toe cap serves to protect the toes, and generally is used to form the face of the three-dimensional figure. Accordingly, in an embodiment, the toe cap includes at least a mouth and eyes, and can further include one or more of the following: antlers, horns, nostrils, and arms. As in this figure, the toe cap further includes horns, and arms. The three-dimensional design of the tree creeper is continued along outsole 54A2, 56C and 54B2 (not shown).

The material of the molded shoe is preferably a molded plastic, but can be made of rubber, vinyl, thermoplastic material, thermosetting plastic material, or any other material that can be molded. The invention can use any molded plastic including Ethylene Vinyl Acetate (EVA), rubber, Thermo-Plastic Rubber (TPR), Polyurethane (PU), (PolyVinyl Chloride) PVC, and combinations thereof. In an embodiment, the shoes of the present invention are an injection molded EVA. EVA, is a copolymer of ethylene and vinyl acetate. EVA is a polymer that is soft and flexible, and processed like a thermoplastic. EVA and other thermoplastic material are commercially available from a number of retailers including Dupont.

Injection molding is a manufacturing technique that uses materials such as thermoplastic and thermosetting plastic materials. Molten plastic is injected at high pressure into a mold, which is the inverse of the shoe's shape (e.g., an inverse of the three dimensional contours of the animal figure and the inverse of the corresponding animal imprint on the bottom imprinting surface). After an embodiment of the present invention is designed, molds are made e.g., from metal, usually either steel or aluminum, and precision-machined to form the features of the shoe.

The shoe of the present invention, in an aspect, is made in part or in whole from a material that is recyclable. In a preferred embodiment, the whole shoe including the strap and optionally the means for securing the strap is made from a recyclable material.

The present invention includes method of printing animal prints on a surface using the shoes of the present invention. The method involves the user who is wearing the shoe stepping on a surface. The act of stepping or applying pressure to the bottom imprinting surface of the shoe creates an impression on the surface. The surface can be a soft or spongy surface, such as soft dirt, mud, and sand. The depth of the indentations (e.g., the protrusions and recesses) that form the animal print on the bottom surface of the shoe allows one to make an impression or imprint on the surface. The method further includes first placing the shoe on the wearer's feet.

Alternatively, the imprints can be made on a harder or flat surface when surface is coated with a print making solutions (e.g., washable paint). In yet another embodiment, solutions which reacts only to the surface on which the user is stepping to show color. Another embodiment is wetting the bottom surface of the shoe and making prints on a dry surface such that the print can be seen when wet.

EXEMPLIFICATION

Example 1

The shoes shown in the FIGS. 1-4 were made using EVA injection molding techniques. A mold of each of the animal shoes were precision machined to form the inverse of the figure. Molten EVA was injected at high pressure into a mold to form the shoe. Snaps were added to the straps for securing the strap to the shoe.

Example 2

The shoes shown in FIGS. 5-7 where made using the following process. These shoes were made using injection molding techniques. A mold of each of the animal shoes were precision machined to form the inverse of the toe cap, sole and outsole of the shoe shown in the FIGS. 5-7. Molten thermoplastic was injected at high pressure into a mold to form the shoe. The modified upper, namely, Z-strap upper, sneaker upper having a hook and loop fastener, modified sneaker upper having laces, or modified "Mary Jane" upper were attached, as shown, to the toe cap and outsoles with adhesive. Snaps or fasteners, where shown, were added to the straps for securing the strap to the shoe.

The relevant teachings of all the references, patents and/or patent applications cited herein are incorporated herein by reference in their entirety.

While this invention has been particularly shown and described with references to preferred embodiments thereof, it will be understood by those skilled in the art that various changes in form and details may be made therein without departing from the scope of the invention encompassed by the appended claims.

What is claimed is:

1. A shoe that comprises:

a. a sole that includes an outsole extending therefrom, wherein the outsole has a bottom surface;

b. a toe cap, wherein the toe cap and the outsole comprise an outer surface that comprises a series of projections and recesses that form a three-dimensional figure having one or more features, wherein the toe cap, the sole, the outsole, and the three-dimensional animal or character figure having one or more features are a single piece formed by a molded material; and c. an upper, adapted to attach to the toe cap and the outsole wherein the toe cap, the sole, the outsole and the three-dimensional animal or character figure having one or more features are a single piece formed by a molded material.

2. The shoe of claim 1, wherein the sole has a bottom surface that comprises a series of projections and recesses that form a print to thereby form an imprinting surface, wherein the figure on the outer surface of the toe cap relates to the print of the imprinting surface.

3. The shoe of claim 1, wherein the molded material comprises Ethylene Vinyl Acetate (EVA), rubber, ThermoPlastic Rubber (TPR), Polyurethane (PU), and (PolyVinyl Chloride) PVC.

4. The shoe of claim 1, wherein the shoe further includes straps, hook and loop fasteners, or laces.

5. A molded shoe, the shoe comprises:

a. a sole having an outsole wherein the outsole has a bottom surface that comprises a series of projections and recesses that form an animal print for an animal, to thereby obtain an animal imprinting surface; and b. a toe cap, wherein the toe cap and the outsole comprise an outer surface that comprises a series of projections and recesses that form a three-dimensional animal figure having one or more features, wherein the toe cap, the sole, the outsole, the animal imprinting surface, and three-dimensional animal having one or more features are a single piece formed by a molded material; and c. an upper, adapted to attach to the toe cap and the outsole; wherein the projections and recesses of the animal imprinting surface allow one wearing the shoe to make imprints, and the animal figure on the outer surface of the upper relates to the animal print of the animal imprinting surface.

6. The molded shoe of claim 5, wherein the molded material is recyclable or made from recycled plastic material.

7. The molded shoe of claim 5, wherein the animal imprinting surface includes projections and recesses that form footprints of the three-dimensional animal figure.

8. The molded shoe of claim 7, wherein the animal imprinting surface has projections, recesses, or both that have a depth that ranges between about 2 mm to about 5 mm to thereby obtain an animal imprinting surface.

9. The molded shoe of claim 5, wherein the toe cap, the outsole or both, include a series of projections and recesses that form an animal figure that has eyes and a mouth.

10. The molded shoe of claim 8, wherein the toe cap, the outsole or both further include a series of projections and recesses that form an animal figure that has one or more of the following: animal skin pattern, feathers, scales, nose, teeth, grass, legs, eyes, toes, feet, ears, fur, mouth, claws or any combination thereof.

11. The molded shoe of claim 9, wherein the projections, recesses or both of the toe cap, outsole or both have a depth that ranges between about 2 mm to about 20 mm.

* * * * *